US012263519B2

(12) United States Patent
Xu et al.

(10) Patent No.: US 12,263,519 B2
(45) Date of Patent: Apr. 1, 2025

(54) PUSH-BENDING FORMING DEVICE AND METHOD FOR TITANIUM ALLOY TUBES

(71) Applicant: Nanchang Hangkong University, Nanchang (CN)

(72) Inventors: Xuefeng Xu, Nanchang (CN); Liming Wei, Nanchang (CN); Chenge Wan, Nanchang (CN); Jie Xiao, Nanchang (CN); Feng Cui, Nanchang (CN); Yubin Fan, Nanchang (CN); Jun Xie, Nanchang (CN); Xiang Zeng, Nanchang (CN); Zhengang Yuan, Nanchang (CN); Hongyu Gan, Nanchang (CN)

(73) Assignee: Nanchang Hangkong University, Nanchang (CN)

( * ) Notice: Subject to any disclaimer, the term of this patent is extended or adjusted under 35 U.S.C. 154(b) by 0 days.

(21) Appl. No.: 18/784,817

(22) Filed: Jul. 25, 2024

(65) Prior Publication Data

US 2024/0399436 A1 Dec. 5, 2024

(30) Foreign Application Priority Data

Jan. 26, 2024 (CN) ..... 202410110092.2

(51) Int. Cl.

| | |
|---|---|
| ***B21D 9/18*** | (2006.01) |
| ***B21D 9/12*** | (2006.01) |
| ***B21D 37/18*** | (2006.01) |
| ***C22F 1/18*** | (2006.01) |

(52) U.S. Cl.

CPC ..... *B21D 9/125* (2013.01); *B21D 9/18* (2013.01); *B21D 37/18* (2013.01); *C22F 1/183* (2013.01)

(58) Field of Classification Search

CPC ..... B21D 7/162; B21D 9/03; B21D 9/125; B21D 9/16; B21D 9/18; B21D 37/18; C22F 1/183

See application file for complete search history.

(56) References Cited

U.S. PATENT DOCUMENTS 1,891,338 A * 12/1932 Snell ..... B21D 9/12 72/286
3,335,485 A * 8/1967 Russo ..... B21C 37/28 29/455.1
4,414,833 A * 11/1983 Nicolas ..... B21D 7/025 72/19.1

FOREIGN PATENT DOCUMENTS

| | | | |
|---|---|---|---|
| CN | 1049304 | A | 2/1991 |
| CN | 1233540 | A | 11/1999 |
| CN | 1891369 | A | 1/2007 |
| CN | 102228922 | A | 11/2011 |

(Continued)

OTHER PUBLICATIONS

JP 59-232626A, Sato Dec. 1984.*

(Continued)

*Primary Examiner* — Edward T Tolan

(57) ABSTRACT

A push-bending forming device for titanium alloy tubes is provided, which includes a die main body, a plurality of filling balls, a differential temperature assembly and a punch. The filling balls are configured to be filled in a tube blank, and are made of a metal material, with a heat-resistance temperature over 500° C. A diameter of the filling ball is less than an inner diameter of the tube blank. The punch includes a first pushing part and a second pushing part. A push-bending forming method using such device is also provided.

9 Claims, 7 Drawing Sheets

(56) References Cited

FOREIGN PATENT DOCUMENTS

| | | | |
|---|---|---|---|
| CN | 103658225 | A | 3/2014 |
| CN | 104148464 | A | 11/2014 |
| CN | 108273889 | A | 7/2018 |
| CN | 109821945 | A | 5/2019 |
| CN | 112139318 | A | 12/2020 |
| CN | 212216799 | U | 12/2020 |
| CN | 212494722 | U | 2/2021 |
| CN | 114346021 | A | 4/2022 |
| GB | 451838 | A | 8/1936 |
| RU | 2528928 | C1 | 9/2014 |

OTHER PUBLICATIONS

CN 105537342A, Yang et al. May 2016.*
CN 111069370A, Tao et al. Apr. 2020.*
CN 103658225A, Li et al. Mar. 2014.*
WO 2005/070581A, Spaeth Aug. 2005.*
CN 110814121A, Xu et al. Feb. 2020.*
Qi Liu et al., "Experiment research on push-bending of thin-walled and small bending radius elbow with long straight tube", Forging Stamping Technology, vol. 43 No. 5, May 31, 2018, pp. 62-67.

* cited by examiner

PUSH-BENDING FORMING DEVICE AND METHOD FOR TITANIUM ALLOY TUBES

CROSS-REFERENCE TO RELATED APPLICATIONS

This application claims the benefit of priority from Chinese Patent Application No. 202410110092.2, filed on Jan. 26, 2024. The content of the aforementioned application, including any intervening amendments thereto, is incorporated herein by reference in its entirety.

TECHNICAL FIELD

This application relates to push-bending forming technologies of tube materials, and more particularly to a push-bending forming device and method for titanium alloy tubes.

BACKGROUND

Push-bending forming is a common bending technology in the plastic processing of tubes, which is based on a hydraulic machine or a press machine, and is mainly suitable for tubes with a small bending radius. In the forming process, the tube blank is forced to move forward along a forming cavity under the action of an axial force of a punch, and is gradually bent under the restriction of a die bent segment, which is generally performed at room temperature. However, by using this technology, a bending radius of the tube blank is restricted. In addition, owing to the hollow cross section, the wall thicknesses on the inside and outside of the tube blank will change during the bending processing, which will easily cause a change in the cross section. Therefore, some forming defects may occur during the bending process, such as tensile crack of the outer wall, wrinkling of the inner wall, cross-section distortion and springback, especially in the bending forming of a thin-wall tube. Different from stainless-steel tubes and aluminum alloy tubes, the titanium alloy tube has characteristics of good corrosion resistance, high specific strength and thermal strength, low thermal expansion coefficient and excellent fatigue strength. Besides, the elongation of the titanium alloy tube will gradually increase as the temperature rises, and thus its plasticity will also be enhanced at a higher temperature, which indicates that the titanium alloy can be easily formed at an elevated temperature.

In order to improve the plastic deformation ability during the bending process and reduce the deformation resistance of materials during the flowing process, Chinese Patent Application No. 201810060245.1 published a differential temperature push-bending forming method and device for tubes with a small bending radius. The disclosure introduces a nonuniform temperature field based on the normal temperature push-bending. Specifically, an outer side of a die bent segment is heated, while an inner side of the die bent segment is cooled with water, such that plastic deformation abilities of inner and outer sides of the tube blank are differentiated along a gradient temperature field. In this case, the elongation of the inside material is inhibited by a relatively low temperature, while the plasticity of the outside material is improved by a relatively high temperature, thereby improving the bending forming performance of the tube blank. However, considering that the inner side of the die bent segment is cooled through water, it is difficult for the outer side to reach the desired high temperature, such method is only suitable for low-temperature forming. At the same time, a filling medium used in the above differential temperature push-bending process is perfluoroether rubber (FFKM) which can only withstand a temperature of 200-300° C. Under the action of a pushing force at the high temperature, the FFKM is prone to being broken, and the broken FFKM is easy to adhere to an inside of the tube blank and hard to be removed (it is often needed to destroy a formed tube to take out the broken FFKM), resulting in low yield and poor production efficiency. In addition, it is necessary to employ a flexible rod to support the FFKM, which not only increases the die cost, but also needs an additional hydraulic system to provide the support. At the same time, when the flexible mandrel support rod supports the FFKM, it is easy to cause failure and scratch on an inner surface of a die, resulting in high die maintenance cost and low yield of the bent tube. Therefore, considering that in the push-bending forming of a titanium alloy tube with a small bending radius, a relatively high temperature is conductive to the plastic deformation and an inside of the titanium alloy tube needs to be filled with a high temperature-resistant medium (with a heat resistance up to 500° C. or more), this application provides a push-bending forming device and method for titanium alloy tubes, which not only provides a high temperature to facilitate the plastic deformation, but also has excellent internal filling. Moreover, this application does not need the flexible rod and the corresponding hydraulic system, exhibiting great practical significance.

SUMMARY

In order to solve the above problems in the prior art, it is necessary to provide a push-bending forming device and method for titanium alloy tubes.

In a first aspect, this application provides a push-bending forming device for titanium alloy tubes, comprising:

a die main body;

a plurality of filling balls;

a differential temperature assembly; and a punch;

wherein the die main body is provided with a forming cavity; a tube blank is configured to be driven to move relative to the forming cavity; the forming cavity is provided with a bent segment; and the forming cavity is configured for push-bending forming of the tube blank to obtain a bent tube;

the plurality of filling balls are configured to be filled in the tube blank; the plurality of filling balls are made of a metal material, and have a heat-resistance temperature over 500° C.; and a diameter of each of the plurality of filling balls is less than an inner diameter of the tube blank;

the differential temperature assembly comprises a first heating device and a second heating device; the first heating device is arranged on an inner side of the bent segment, and is configured to heat the inner side of the bent segment to a first preset temperature; the second heating device is arranged on an outer side of the bent segment, and is configured to heat the outer side of the bent segment to a second preset temperature; and the first preset temperature is lower than the second preset temperature; and the punch comprises a first pushing part and a second pushing part; a diameter of the first pushing part is smaller than an inner diameter of the tube blank; the first pushing part is configured to push the plurality of filling balls into the tube blank; a diameter of the second pushing part is larger than the inner diameter of the tube blank; and the second pushing part is configured to push the tube blank to move along the bent segment.

In an embodiment, the first heating device comprises a first heating element and a first thermocouple; the first heating element is arranged on the inner side of the bent segment along an extending direction of the forming cavity, and is configured to heat the inner side of the bent segment to the first preset temperature; and the first thermocouple is arranged on the inner side of the bent segment, and is configured to detect a temperature of the inner side of the bent segment.

In an embodiment, the second heating device comprises a second heating element and a second thermocouple; the second heating element is arranged on the outer side of the bent segment, and is configured to heat the outer side of the bent segment to the second preset temperature; and the second thermocouple is arranged on the outer side of the bent segment, and is configured to detect a temperature of the outer side of the bent segment.

In an embodiment, the differential temperature assembly further comprises a temperature controller; the temperature controller is electrically connected with the first thermocouple and the second thermocouple; and the temperature controller is configured to receive temperature information from the first thermocouple and the second thermocouple and calculate a temperature difference between the first thermocouple and the second thermocouple.

In an embodiment, the push-bending forming device further comprises a heat insulation base; and the heat insulation base is covered on an outside of the die main body, and is configured to insulate the die main body.

In an embodiment, the accommodating cavity is provided in the die main body; the accommodating cavity is communicated with the forming cavity, and is configured to accommodate the plurality of filling balls; and the plurality of filling balls are configured to enter the forming cavity through the accommodating cavity.

This application also provides a push-bending forming method for titanium alloy tubes using the push-bending forming device for titanium alloy tubes, comprising:

(S1) starting the first heating device to heat the inner side of the bent segment to the first preset temperature and keeping the inner side of the bent segment at the first preset temperature, and starting the second heating device to heat the outer side of the bent segment to the second preset temperature and keeping the outer side of the bent segment at the second preset temperature, such that a temperature difference is formed between the inner side of the bent segment and the outer side of the bent segment; wherein the first preset temperature is 200-300° C.; the second preset temperature is 400-500° C.; after reaching the first preset temperature, a temperature change of the inner side of the bent segment is less than 2° C., and after reaching the second preset temperature, a temperature change of the outer side of the bent segment is less than 2° C.;

(S2) when a temperature difference between the first preset temperature and the second preset temperature is 100-300° C., aligning a front end of the tube blank with an inlet of the bent segment; opening the accommodating cavity to allow a preset number of filling balls among the plurality of filling balls to move into the forming cavity, wherein the preset number of filling balls constitute a first filling ball group, and a gap between adjacent filling balls among the first filling ball group is less than 1 mm; pushing, by the first pushing part, the first filling ball group into the tube blank at a uniform speed until an end of a first filling ball of the first filling ball group away from the punch is flush with the front end of the tube blank, and driving the second pushing part to push the tube blank into the bent segment for bending, wherein after bending the tube blank to an angle of 10°-30°, the first filling ball of the first filling ball group is separated from the tube blank and pushed into the forming cavity;

(3) moving the punch in a direction away from the tube blank, so that one of filling balls among the plurality of filling balls in the accommodating cavity moves into the forming cavity; driving the first pushing part to push the one filling ball leaving the accommodating cavity into the tube blank, wherein at this time, filling balls in the tube blank constitute a second filling ball group; pushing, by the first pushing part, the second filling ball group to drive the tube blank to move relative to the forming cavity, until a first filling ball of the second filling ball group is separated from the tube blank and pushed into the forming cavity; and (4) repeating step (S3) until the bent tube is obtained, wherein a motion trajectory of each of the plurality of filling balls in the tube blank is a continuous envelope curve.

In an embodiment, the push-bending forming method further comprises:

(S1') prior to the step (S1), cutting an angle of 45-60° on the front end of the tube blank with a length of L along an inner side of a bending direction, and cutting an angle of 30-60° on a rear end of the tube blank along the inner side of the bending direction, wherein the rear end of the tube blank is in contact with the punch; cutting the rear end of the tube blank from a central line of the tube blank toward an outer side of the bending direction to make an end surface of the tube blank in contact with the punch flat; and deburring the front end and the rear end of the tube blank, and cleaning an inner side and outer side of the tube blank.

In an embodiment, the push-bending forming method further comprises:

(S1") spraying a lubricant on the outer side of the tube blank;

wherein the step (S1") is performed before the step (S1) and after the step (S1').

In an embodiment, the push-bending forming method further comprises:

removing the lubricant from the tube blank.

The push-bending forming device provided herein for titanium alloy tubes, on the basis of differential temperature push-bending, adopts metal filling balls as the solid filling medium to be filled into the tube blank, and the diameter of the filling ball is slightly less than the inner diameter of the tube blank. Since a hardness of the filling ball is larger than that of perfluoroether rubber (FFKM), the filling balls can directly provide support force for the tube blank, and thus it is not necessary to additionally provide a flexible mandrel support rod to support an end of the tube blank away from the punch to squeeze the filling medium in the tube blank to provide the support force for the inside of the tube blank. In this way, the filling balls can effectively provide support force for the tube blank in a deformation zone, so that the tube blank within the deformation zone is subjected to a combined action of an inner pressure from the filling balls and an outer pressure from the die main body, which improves the plastic deformation ability of the tube blank in the deformation zone, reduces the die cost and eliminates the need of a hydraulic system, thereby reducing the production cost and simplifying the device structure. In addition, the filling ball can withstand a temperature over 500° C., which avoids the problem that the FFKM is prone to crack under the action of a pushing force at a high temperature, and improves the yield and production efficiency of the bent tubes.

BRIEF DESCRIPTION OF THE DRAWINGS

In order to illustrate the technical solutions of embodiments of this application or the prior art more clearly, the accompanying drawings required in the description of embodiments of this application or the prior art will be briefly introduced below. It is obvious that presented in the accompanying drawings are merely some embodiments of this application. For those of ordinary skill in the art, other relevant accompanying drawings can also be obtained according to these drawings without making creative effort.

In the figures: 1, die main body; 11, bent segment; 12, input segment; 13, output segment; 14, positioning hole; 15, porous silicon heat-insulating plate; 16, guide bushing; 2, tube blank; 3, filling ball; 4, differential temperature assembly; 41, first heating device; 42, second heating device; 43, first heating element; 431, first heating rod; 432, second heating rod; 44, first thermocouple; 45, second heating element; 46, second thermocouple; 47, temperature controller; 5, punch; 51, first pushing part; 52, second pushing part; 6, heat insulation base; 61, heat insulating plate; 62, base plate; 63, mounting groove; 64, punch hole; 65, through groove; and 66, cable hole.

The objects, functional characteristics and advantages of the present disclosure will be further described with reference to the embodiments and the accompanying drawings.

DETAILED DESCRIPTION OF EMBODIMENTS

The technical solutions of the embodiments of the present disclosure will be clearly and completely described with reference to the accompanying drawings of the embodiments of the present disclosure. It is obvious that described herein are only some embodiments of the present disclosure, rather than all embodiments. Based on the embodiments of the present disclosure, other embodiments obtained by those of ordinary skill in the art without making creative effort shall fall within the scope of the present disclosure.

It should be noted that the terms, such as "up", "down", "left", "right", "front", "rear" and other directional indications used herein, are only used for illustrating relative position relationship and motion between components in a specific state (as shown in the accompanying drawings). If the specific state changes, the directional indication accordingly changes.

In addition, the terms "first" and "second" are only used for distinguishment rather than indicating or implying the relative importance or implicitly specifying the number of technical features indicated. Therefore, a feature defined with "first" or "second" may explicitly or implicitly indicates the inclusion of at least one of such features. Besides, the term "and/or" used herein includes three solutions, for example, "A" and/or "B" includes solution "A", solution "B", and a combination thereof. Technical solutions of embodiments can be combined with each other as long as the combined solution can be implemented by those skilled in the art. When a combination of the technical solutions is contradictory or cannot be realized, it should be considered that such a combination does not exist, and is not within the scope of the present disclosure.

Figure 1:
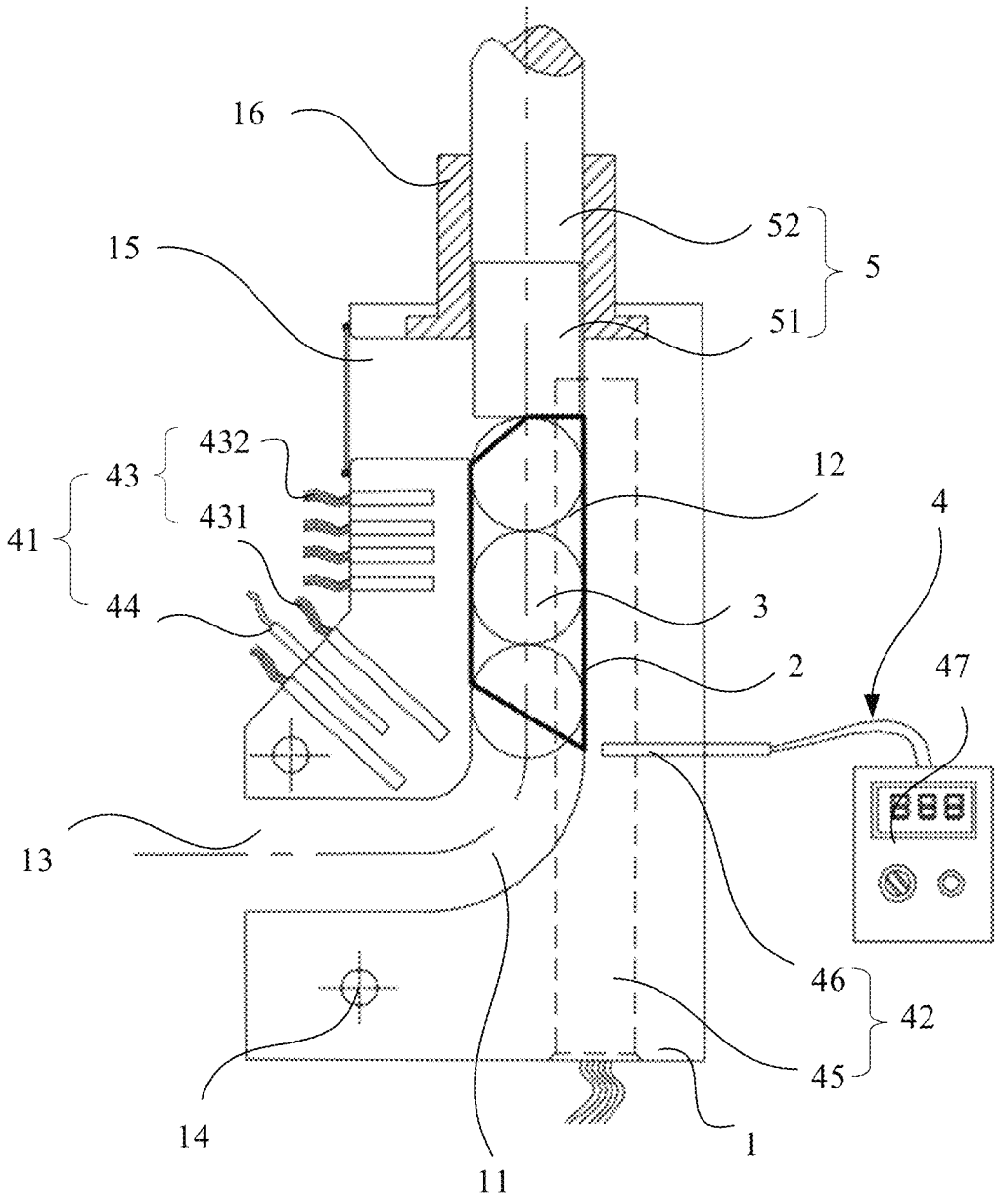
FIG. 1 schematically shows a structure of a push-bending forming device for titanium alloy tubes according to an embodiment of the present disclosure.

Referring to FIG. 1, a push-bending forming method for titanium alloy tubes using a push-bending forming device for titanium alloy tubes is provided. The push-bending device includes a die main body 1, a plurality of filling balls 3, a differential temperature assembly 4 and a punch 5. The die main body 1 is provided with a forming cavity. A tube blank 2 is configured to be driven to move relative to the forming cavity. The forming cavity is provided with a bent segment 11, and the forming cavity is configured for push-bending forming of the tube blank 2 to obtain a bent tube. The plurality of filling balls 3 is configured to be filled in the tube blank 2 along an axis of the tube blank 2. The plurality of filling balls 3 are made of a metal material, and having a heat-resistance temperature over 500° C. A diameter of each of the plurality of filling balls 3 is less than an inner diameter of the tube blank 2. The differential temperature assembly 4 includes a first heating device 41 and a second heating device 42. The first heating device 41 is arranged on an inner side of the bent segment 11, and is configured to heat the inner side of the bent segment 11 to a first preset temperature. The second heating device 42 is arranged on an outer side of the bent segment 11, and is configured to heat the outer side of the bent segment 11 to a second preset temperature. The first preset temperature is lower than the second preset temperature. The punch 5 includes a first pushing part 51 and a second pushing part 52. A diameter of the first pushing part 51 is smaller than an inner diameter of the tube blank 2. The first pushing part 51 is configured to push the plurality of filling balls 3 into the tube blank 2. A diameter of the second pushing part 52 is larger than the inner diameter of the tube blank 2. The second pushing part 52 is configured to push the tube blank 2 to move along the bent segment 11.

In an embodiment, the diameter of each filling ball 3 is 0.1-0.2 mm less than the inner diameter of the tube blank 2.

The push-bending forming device provided herein for titanium alloy tubes, on the basis of differential temperature push-bending, adopts metal filling balls as the solid filling mediums to be filled into the tube blank 2, and the diameter of each of the plurality of filling balls 3 is slightly less than the inner diameter of the tube blank 2. Since a hardness of each of the plurality of filling balls 3 is larger than that of perfluoroether rubber (FFKM), the plurality of filling balls 3 can directly provide support force for the tube blank 2, and thus it is not necessary to additionally provide a flexible mandrel support rod to support an end of the tube blank 2 away from the punch 5 to squeeze the filling mediums in the tube blank 2 to provide the support force for the inside of the tube blank 2. In this way, the plurality of filling balls 3 can effectively provide support force for the tube blank in a deformation zone in the tube blank 2, so that the tube blank within the deformation zone in the tube blank 2 is subjected to a combined action of an inner pressure from the plurality of filling balls 3 and an outer pressure from the die main body 1, which improves the plastic deformation ability of the tube blank in the deformation zone, reduces the die cost and eliminates the need of a hydraulic system, thereby reducing the production cost and simplifying the device structure. In addition, the plurality of filling balls 3 can withstand a temperature over 500° C., which avoids the problem that the FFKM is prone to crack under the action of a pushing force at a high temperature, and improves the yield and production efficiency of the bent tubes.

In addition, the plurality of filling balls 3 are configured to be filled into the deformation zone of the bent segment, so that the tube blank in the deformation zone can improve the uniformity of deformation and avoid cross-section distortion and wrinkling defects through a support function of the plurality of filling balls 3. In addition, the plurality of filling balls 3 are adopted to change a processing method, that is, no flexible mandrel support rod is required, which greatly reduces the production cost.

In an embodiment, the diameter of each of the plurality of filling balls 3 is 1 mm less than the inner diameter of the tube blank 2, in this way, the plurality of filling balls 3 can provide the support force for the inside of the tube blank 2, and move relative to the tube blank 2.

In an embodiment, the plurality of filling balls 3 are made of a hard alloy, which have high hardness, high strength, wear resistance and corrosion resistance. In this embodiment, each of the plurality of filling balls 3 is a steel ball with high temperature resistance.

Referring to FIG. 1, the first heating device 41 includes a first heating element 43 and a first thermocouple 44. The first heating element 43 is arranged on the inner side of the bent segment 11 along an extending direction of the forming cavity, and is configured to heat the inner side of the bent segment 11 to the first preset temperature. The first thermocouple 44 is arranged on the inner side of the bent segment 11, and is configured to detect a temperature of the inner side of the bent segment 11.

In addition, the forming cavity further includes an input segment 12 and an output segment 13. The input segment 12 is communicated with a first end of the bent segment 11, and the output segment 13 is communicated with a second end of the bent segment 11. The tube blank 2 is configured to be driven to sequentially enter the bent segment 11 and the output segment 13 through the input segment 12. The punch 5 is configured to enter the forming cavity through the input segment 12 and push the tube blank 2 to move along the forming cavity.

In an embodiment, the forming cavity is configured to fit the tube blank 2.

In an embodiment, the die main body 1 further includes a guide bushing 16. The guide bushing 16 is arranged on an end of the input segment 12 away from the bent segment 11. The punch 5 is provided in the guide bushing 16, and a bore diameter of the guide bushing 16 is matched to an outer diameter of the punch 5. The guide bushing 16 is configured to guide a movement of the punch 5 relative to the input segment 12.

In an embodiment, the first heating element 43 includes a first heating rod 431 and a second heating rod 432. The first heating rod 431 is arranged on the inner side of the bent segment 11 along an extending direction of the bent segment 11, and the second heating rod 432 is arranged on an inner side of the input segment 12 along an extending direction of the input segment 12, so as to make the temperature at the bending inner side of the tube blank 2 uniform. The first thermocouple 44 is arranged between first heating rods 431.

In this embodiment, the number of the first heating rod 431 is two, and the number of the second heating rod is four.

The second heating device 42 includes a second heating element 45 and a second thermocouple 46. The second heating element 45 arranged on the outer side of the bent segment 11, and is configured to heat the outer side of the bent segment 11 to the second preset temperature. The second thermocouple 46 is arranged on the outer side of the bent segment 11, and is configured to detect a temperature of the outer side of the bent segment 11.

In an embodiment, the second heating element 45 is a heating rod.

In an embodiment, the first heating element 43 is arranged on an outer side of the input segment 12 and the bent segment 11 along the extending direction of the input segment 12 to balance a temperature of a bending outer side of the tube blank 2. The second thermocouple 46 is arrange on a connection between the input segment 12 and the bent segment 11.

In an embodiment, the differential temperature assembly 4 further includes a temperature controller 47. The temperature controller 47 is electrically connected with the first thermocouple 44 and the second thermocouple 46. The temperature controller 47 is configured to receive temperature information from the first thermocouple 44 and the second thermocouple 46 and calculate a temperature difference between the first thermocouple 44 and the second thermocouple 46.

In an embodiment, the temperature controller 47 is configured to detect and display temperatures detected by the first thermocouple 44 and the second thermocouple 46 in real time. After heating for a period of time, the temperature controller 47 is also configured to display the temperature difference between the first thermocouple 44 and the second thermocouple 46. Whether to perform the push-bending forming on a titanium alloy tube is determined according to the temperature difference. In an embodiment, the first thermocouple 44 is heated to the first preset temperature, and keeps the first preset temperature constant, where the first preset temperature is 200-300° C., and the second thermocouple 46 is heated to the second preset temperature, and keeps the second preset temperature constant, where the second preset temperature is 400-500° C. After a temperature of the first thermocouple 44 is constant, a temperature change of the first thermocouple 44 is less than 2° C., and after a temperature of the second thermocouple 46 is constant, a temperature change of the second thermocouple 46 is less than 2° C., so that a temperature difference is formed between the inner side of the bent segment 11 and the outer side of the bent segment 11, and the push-bending forming can be performed on the titanium alloy tube. Such arrangement is based on a formability and energy consumption of the titanium alloy tubes. In addition, the above temperature can meet forming requirements of the titanium alloy tubes, and there is no need to continue to increase the temperature.

Figure 2:
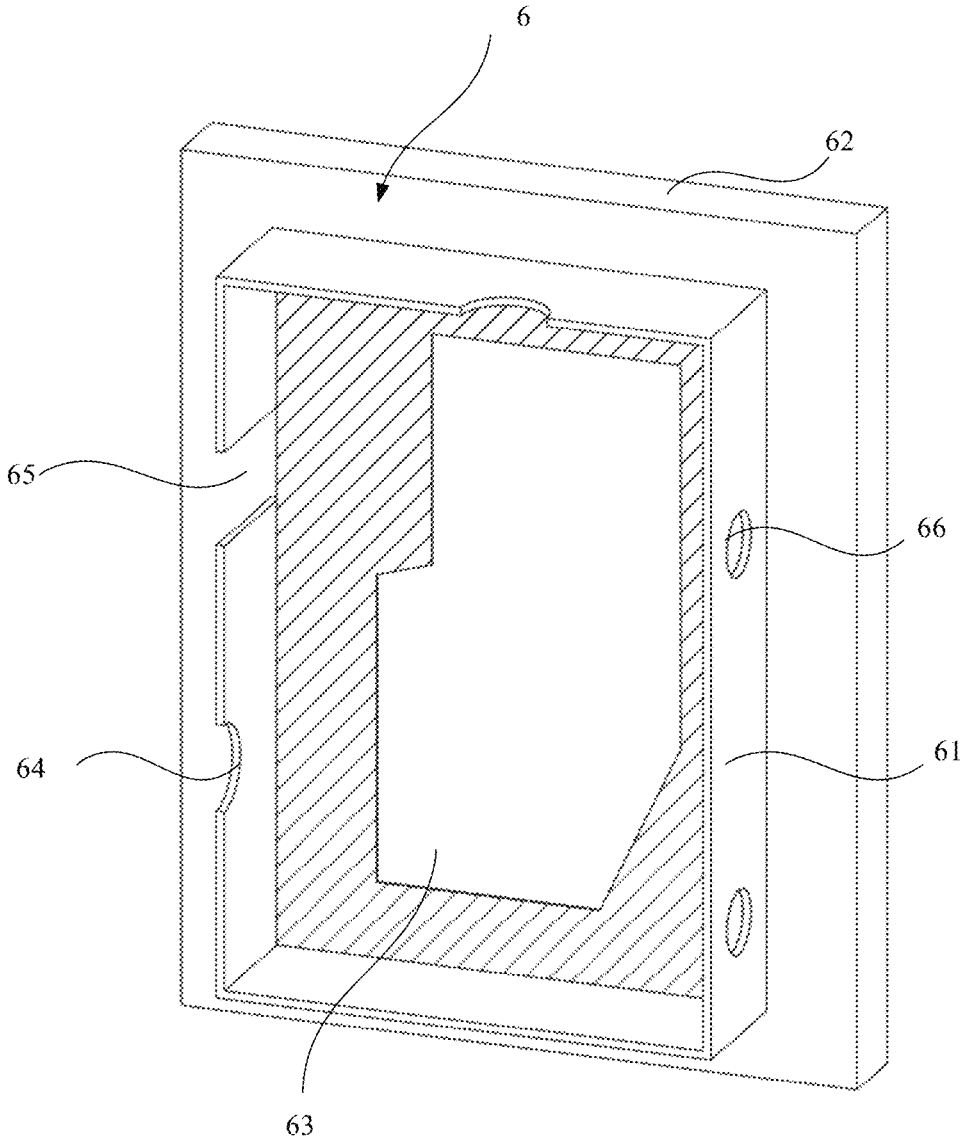
FIG. 2 is a schematic diagram of a heat insulation base according to an embodiment of the present disclosure.

Referring to FIG. 2, the push-bending forming device further includes a heat insulation base 6. The heat insulation base 6 is covered on an outside of the die main body 1, and is configured to insulate the die main body 1.

The die main body 1 is provided with a positioning hole 14. A bolt is configured to pass through the heat insulation base 6 and the positioning hole 14 sequentially to realize aligned positioning of the heat insulation base 6 and the die main body 1.

In an embodiment, the heat insulation base 6 includes a heat insulating plate 61 and a base plate 62. The heat insulating plate 61 is arranged on the base plate 62. The heat insulating plate 61 has a cuboid structure with an internal hollow. The heat insulating plate 61 and the base plate 62 are enclosed to form a mounting groove 63. The mounting groove 63 is configured to accommodate the die main body 1.

In an embodiment, the heat insulating plate 61 is provided with a punch hole 64 and a through groove 65. The punch hole 64 is configured to allow the punch 5 to move, and the through groove 65 is configured to allow the plurality of filling balls 3 to enter the forming cavity.

The heat insulation base 6 is configured to insulate the die main body 1, so that the first heating element 43 and the second heating element 45 are configured to heat at the same time while controlling temperatures of the inner side and outer side of the bent segment 11, respectively, which can reach a higher temperature, improving the plasticity of the titanium alloy tube, realizing the temperature difference between the inner side and outer side of the bent segment 11, and avoiding the wrinkling caused by high temperature of the inner side of the bent segment 11. By means of the heat insulation effect of the heat insulating plate 61 and the heat insulation function of heat insulation asbestos with glass fiber filled inside the heat insulation base 6, a heat loss is reduced, which greatly shortens the heating time of a die, heats the die to a higher temperature, and improves an efficiency of push-bending forming of tube.

In an embodiment, the heat insulating plate 61 is provided with a cable hole 66. The cable hole 66 is configured to allow the first heating element 43, the first thermocouple 44, the second heating element 45 and the second thermocouple 46 to pass through.

Referring to FIG. 1, the die main body 1 is provided with an accommodating cavity. The accommodating cavity is communicated with the forming cavity. The accommodating cavity is configured to accommodate the plurality of filling balls 3, and the plurality of filling balls enter the forming cavity through the accommodating cavity. The die main body further includes a porous silicon heat-insulating plate 15. The porous silicon heat-insulating plate 15 is configured to cover the accommodating cavity to realize opening and closing of the accommodating cavity. The porous silicon heat-insulating plate 15 is also configured to prevent external heat from being transferred to the plurality of filling balls 3.

A push-bending forming method for titanium alloy tubes using the push-bending device for titanium alloy tubes includes the following steps.

Figure 3:
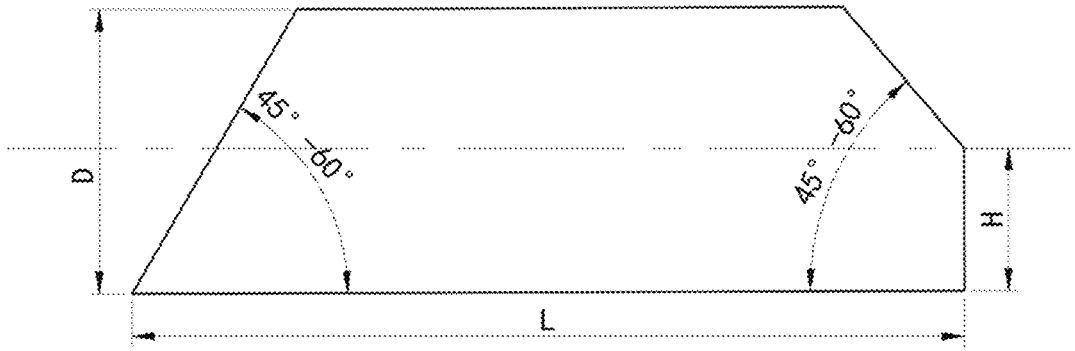
FIG. 3 schematically shows a structure of a tube blank loaded in the push-bending forming device according to an embodiment of the present disclosure.
Figure 4A:
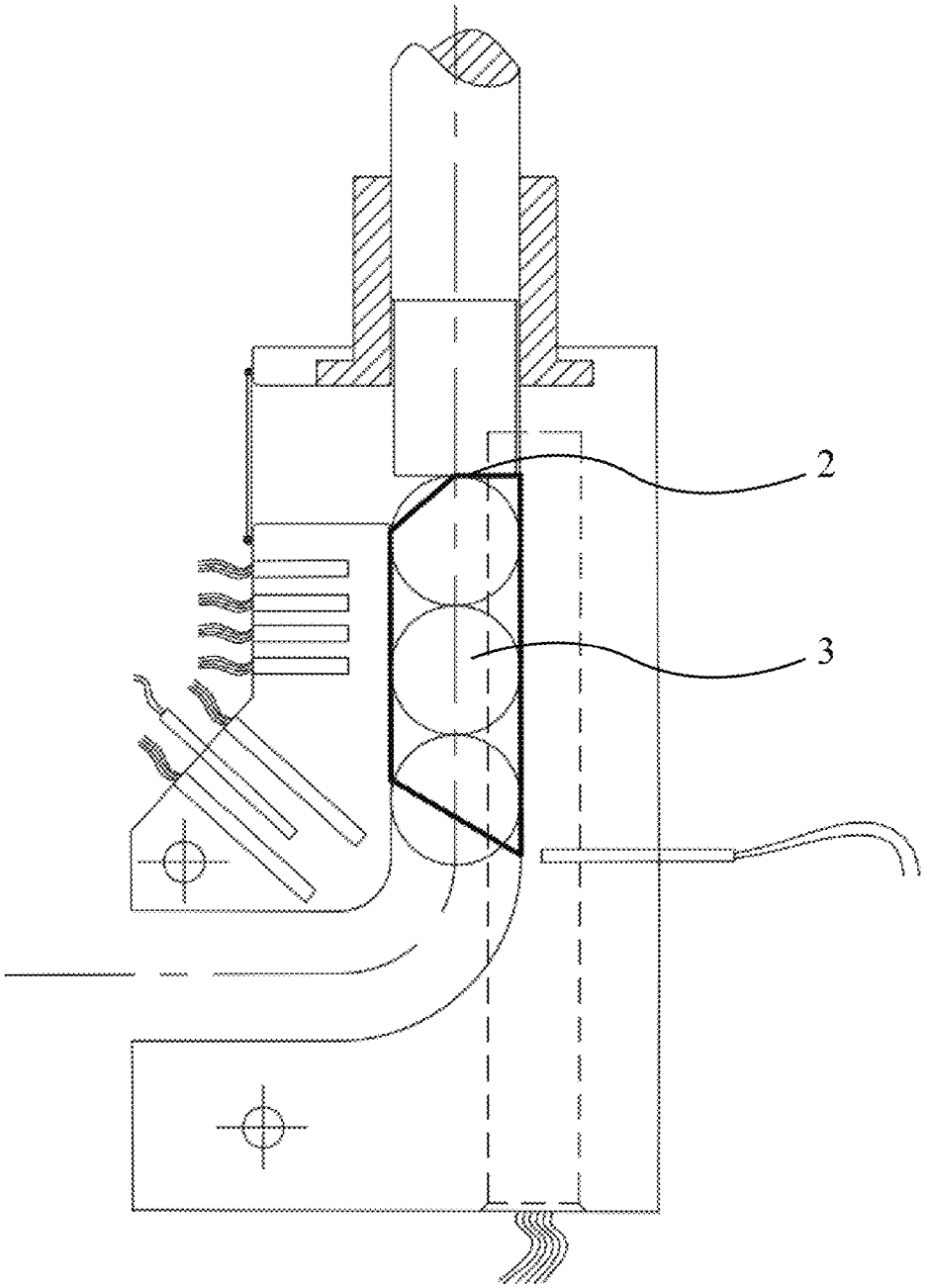
FIG. 4A schematically shows a first stage of a push-bending forming process according to an embodiment of the present disclosure.
Figure 4B:
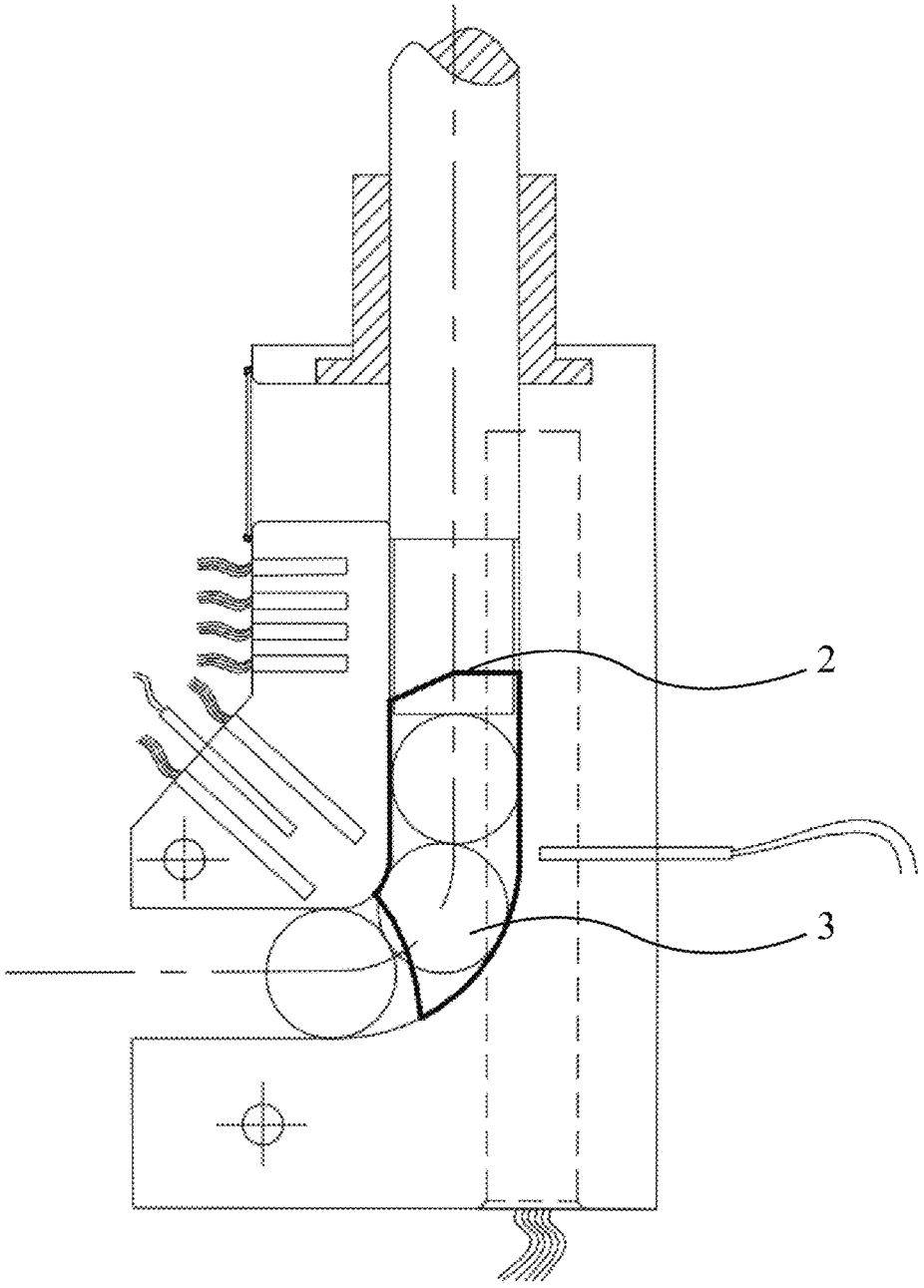
FIG. 4B schematically shows a second stage of the push-bending forming process according to an embodiment of the present disclosure.
Figure 4C:
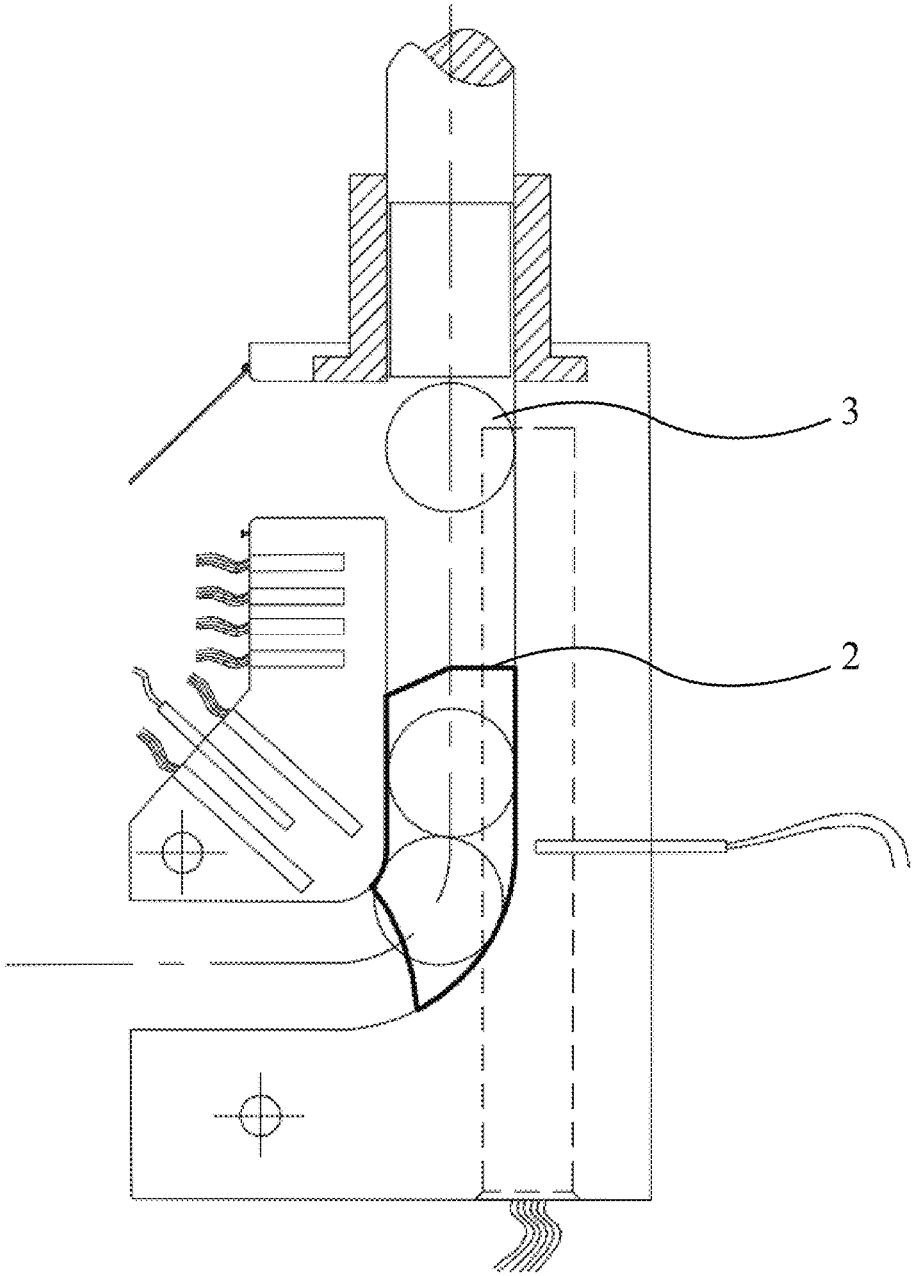
FIG. 4C schematically shows a third stage of the push-bending forming process according to an embodiment of the present disclosure.
Figure 4D:
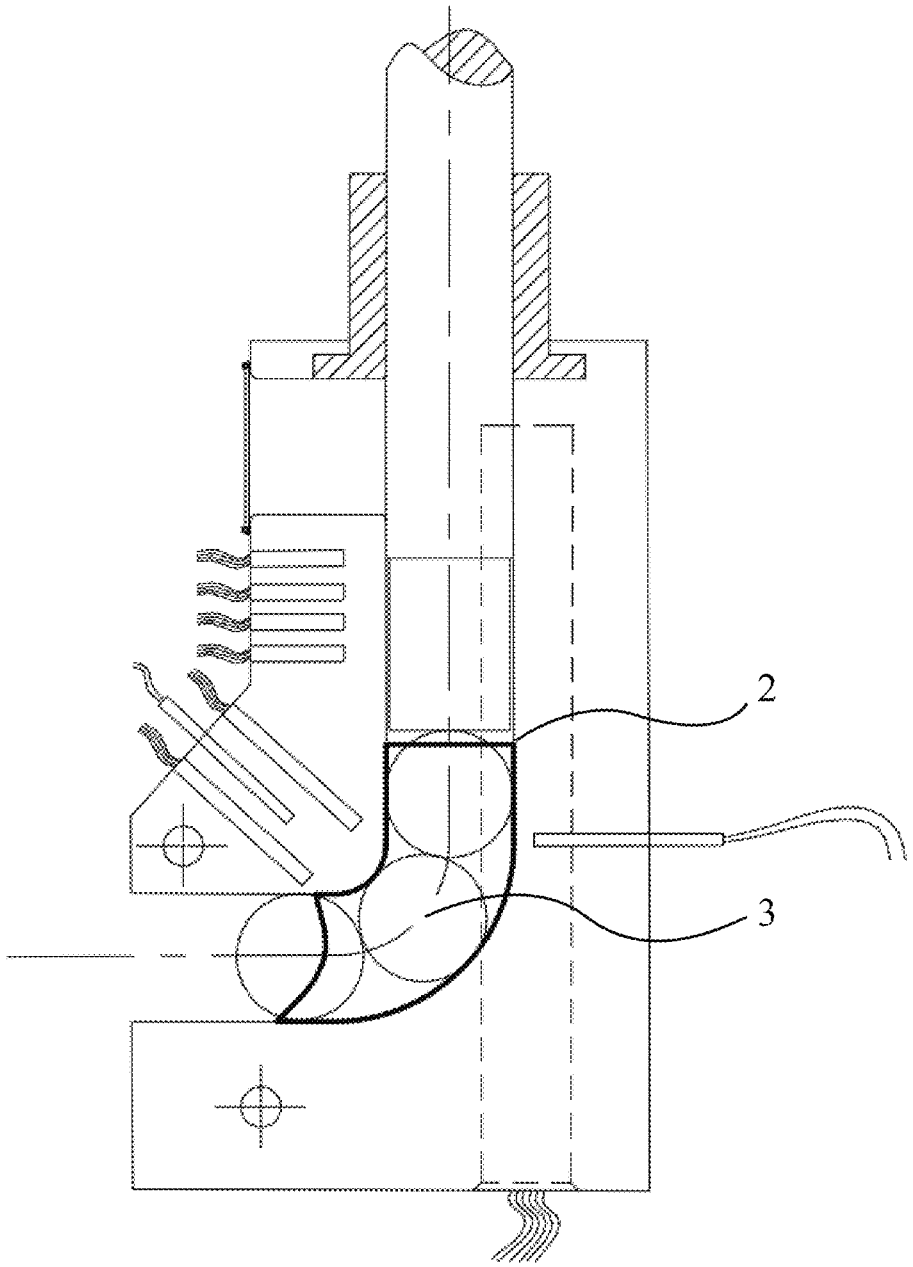
FIG. 4D schematically shows a fourth stage of the push-bending forming process according to an embodiment of the present disclosure.

(S1) Referring to FIG. 3, a front end of a tube blank 2 with a length of Lis cut with an angle of 45-60° along an inner side of a bending direction, and a rear end of the tube blank 2, is cut with an angle of 30-60° along the inner side of the bending direction, where the rear end of the tube blank 2 is in contact with the punch 5. The rear end of the tube blank 2 is cut from a central line of the tube blank toward an outer side of the bending direction to make an end surface of the tube blank 2 in contact with the punch 5 flat. The front end and the rear end of the tube blank 2 are deburred and an inner side and an outer side of the tube blank 2 are cleaned.

In step (1), referring to FIG. 3, a whole length of the tube blank 2 is calculated as follows:

$$L = \frac{\pi}{2}R + 2l + 2c;$$

where L represents the whole length of the tube blank 2; R represents a relative bending radius; l represents a length of a straight segment on both sides of the bent segment 11; and c represents a machining allowance.

In an embodiment, the relative bending radius represents a ratio of a radius of the bent segment 11 and the diameter of the tube blank 2.

(S2) A lubricant is sprayed on the outer side of the tube blank 2. After spraying, the tube blank 2 is put into the forming cavity. The lubricant is a high temperature resistant lubricant.

(S3) The first heating device 41 is started to heat inner side of the bent segment 11 to the first preset temperature and keeping the inner side of the bent segment 11 at the first preset temperature, and the second heating device 42 is started to heat the outer side of the bent segment 11 to the second preset temperature and keeping the outer side of the bent segment 11 at the second preset temperature, such that a temperature difference is formed between the inner side of the bent segment 11 and the outer side of the bent segment 11; where the first preset temperature is 200-300° C., and the second preset temperature is 400-500° C. After reaching the first preset temperature, a temperature change of the inner side of the bent segment 11 is less than 2° C. After reaching the second preset temperature, a temperature change of the outer side of the bent segment 11 is less than 2° C.

(S4) Referring to FIGS. 4A-4D, a push-bending forming process of a titanium alloy tube is depicted. When the difference between the first preset temperature and the second preset temperature is 100-300° C., the front end of the tube blank 2 is aligned with an inlet of the bent segment. The accommodating cavity is opened to allow a preset number of filling balls 3 among the plurality of filling balls 3 to move into the forming cavity, where the preset number of filling balls 3 constitute a first filling ball group, and a gap between adjacent filling balls 3 among the first filling ball group is less than 1 mm. The first pushing part 51 slowly pushes the first filling ball group into the tube blank 2 at a uniform speed until an end of a first filling ball 3 of the first filling ball group 3 away from the punch 5 is flush with the front end of the tube blank 2, then the second pushing part 52 is driven to push the tube blank 2 into the bent segment 11 for bending, where after the tube blank 2 is bent to an angle of 10°-30°, the first filling ball 3 of the first filling ball group is separated from the tube blank 2 and pushed into the forming cavity.

(S5) The punch 5 is moved in a direction away from the tube blank 2, so that one of filling balls 3 among the plurality of filling balls 3 in the accommodating cavity moves into the forming cavity, where the first heating device 41 continues to heat to keep the inner side of the bent segment 11 at the first preset temperature, and the second heating device 42 continues to heat to keep the outer side of the bent segment 11 at the second preset temperature. The first pushing part 51 is driven to push the one filling ball 3 leaving the accommodating cavity into the tube blank 2, where at this time, filling balls 3 in the tube blank 2 constitute a second filling ball group. Then the first pushing part 51 pushes the second filling ball group to drive the tube blank 2 to move relative to the forming cavity, until a first filling ball 3 of the second filling ball group 3 is separated from the tube blank 2 and pushed into the forming cavity.

(S6) Step (S5) is repeated for 3-4 times until the bent tube is obtained, where a motion trajectory of each of the plurality of filling balls 3 in the tube blank 2 is a continuous envelope curve until a titanium alloy tube is bent.

In an embodiment, in a process of the first pushing part 51 pushing the plurality of filling balls 3, the tube blank 2 moves relative to the steel ball under the action of friction, that is, the steel ball moves forward at a same distance relative to an inner wall of the tube blank 2 as the tube blank 2 moves forward. After the tube blank 2 reaches the bent segment 11, the punch 5 is retracted, and one filling ball 3 in the accommodating cavity is pushed into the tube blank 2. The above step is repeated, so that a motion trajectory of each of the plurality of filling balls 3 in the tube blank is a continuous envelope curve during the push-bending forming process, which avoids a large gap between each steel ball during the push-bending forming process, and avoids bending inner side wrinkling of the tube blank 2 caused by no filling ball 3 in the tube blank 2 at a certain time. In addition, push-bending forming of a tube blank with a length-to-diameter ratio can be realized, which avoids whole filling of the tube blank 2 and waste of the filling mediums. The filling mediums can be recycled, which improves the utilization rate of the filling mediums, reduces waste and reduces the production cost.

(S7) The lubricant is removed from the tube blank 2, and a formed titanium alloy tube is obtained.

Described above are only preferred embodiments of this application, and are not intended to limit the scope of this application. Under the sprits of this application, any equivalent replacements or direct/indirect application in other arts by utilizing the specification and accompanying drawings of this application shall fall within the scope of this application defined by the appended claims.

What is claimed is:

1. A push-bending forming method for titanium alloy tubes using a push-bending forming device, the push-bending forming device comprising:

a die main body;

a plurality of filling balls;

a differential temperature assembly; and a punch;

the die main body being provided with a forming cavity; a tube blank being configured to be driven to move relative to the forming cavity; the forming cavity being provided with a bent segment; and the forming cavity being configured for push-bending forming of the tube blank to obtain a bent tube;

the plurality of filling balls being configured to be filled in the tube blank; the plurality of filling balls being made of a metal material, and having a heat-resistance temperature over 500° C.; and a diameter of each of the plurality of filling balls being less than an inner diameter of the tube blank;

the differential temperature assembly comprising a first heating device and a second heating device; the first heating device being arranged on an inner side of the bent segment, and being configured to heat the inner side of the bent segment to a first preset temperature; the second heating device being arranged on an outer side of the bent segment, and being configured to heat the outer side of the bent segment to a second preset temperature; and the first preset temperature being lower than the second preset temperature; and the punch comprising a first pushing part and a second pushing part; a diameter of the first pushing part being smaller than an inner diameter of the tube blank; the first pushing part being configured to push the plurality of filling balls into the tube blank; a diameter of the second pushing part being larger than the inner diameter of the tube blank; and the second pushing part being configured to push the tube blank to move along the bent segment; and the push-bending forming method comprising:

(S1) starting the first heating device to heat the inner side of the bent segment to the first preset temperature and keeping the inner side of the bent segment at the first preset temperature, and starting the second heating device to heat the outer side of the bent segment to the second preset temperature and keeping the outer side of the bent segment at the second preset temperature, such that a temperature difference is formed between the inner side of the bent segment and the outer side of the bent segment; wherein the first preset temperature is 200-300° C.; the second preset temperature is 400-500° C.; after reaching the first preset temperature, a temperature change of the inner side of the bent segment is less than 2° C.; and after reaching the second preset temperature, a temperature change of the outer side of the bent segment is less than 2° C.;

(S2) when a temperature difference between the first preset temperature and the second preset temperature is 100-300° C., aligning a front end of the tube blank with an inlet of the bent segment; opening an accommodating cavity to allow a preset number of filling balls among the plurality of filling balls to move into the forming cavity, wherein the preset number of filling balls constitute a first filling ball group, and a gap between adjacent filling balls among the first filling ball group is less than 1 mm; pushing, by the first pushing part, the first filling ball group into the tube blank at a uniform speed until an end of a first filling ball of the first filling ball group away from the punch is flush with the front end of the tube blank, and driving the second pushing part to push the tube blank into the bent segment for bending, wherein after bending the tube blank to an angle of 10°-30°, the first filling ball of the first filling ball group is separated from the tube blank and pushed into the forming cavity;

(S3) moving the punch in a direction away from the tube blank, so that one of filling balls among the plurality of filling balls in the accommodating cavity moves into the forming cavity; driving the first pushing part to push the one filling ball leaving the accommodating cavity into the tube blank, wherein at this time, filling balls in the tube blank constitute a second filling ball group; pushing, by the first pushing part, the second filling ball group to drive the tube blank to move relative to the forming cavity, until a first filling ball of the second filling ball group is separated from the tube blank and pushed into the forming cavity; and (S4) repeating step (S3) until the bent tube is obtained, wherein a motion trajectory of each of the plurality of filling balls in the tube blank is a continuous envelope curve.

2. The push-bending forming method of claim 1, wherein the first heating device comprises a first heating element and a first thermocouple; the first heating element is arranged on the inner side of the bent segment along an extending direction of the forming cavity, and is configured to heat the inner side of the bent segment to the first preset temperature; and the first thermocouple is arranged on the inner side of the bent segment, and is configured to detect a temperature of the inner side of the bent segment.

3. The push-bending forming method of claim 2, wherein the second heating device comprises a second heating element and a second thermocouple; the second heating element is arranged on the outer side of the bent segment, and is configured to heat the outer side of the bent segment to the second preset temperature; and the second thermocouple is arranged on the outer side of the bent segment, and is configured to detect a temperature of the outer side of the bent segment.

4. The push-bending forming method of claim 3, wherein the differential temperature assembly further comprises a temperature controller; the temperature controller is electrically connected with the first thermocouple and the second thermocouple; and the temperature controller is configured to receive temperature information from the first thermocouple and the second thermocouple and calculate a temperature difference between the first thermocouple and the second thermocouple.

5. The push-bending forming method of claim 1, wherein the push-bending forming device further comprises a heat insulation base; the heat insulation base is covered on an outside of the die main body, and is configured to insulate the die main body.

6. The push-bending forming method of claim 1, wherein the accommodating cavity is provided in the die main body; the accommodating cavity is communicated with the forming cavity, and is configured to accommodate the plurality of filling balls; and the plurality of filling balls are configured to enter the forming cavity through the accommodating cavity.

7. The push-bending forming method of claim 1, further comprising:

(S1') prior to the step (S1), cutting an angle of 45-60° on the front end of the tube blank with a length of L along an inner side of a bending direction, and cutting an angle of 30-60° on a rear end of the tube blank along the inner side of the bending direction, wherein the rear end of the tube blank is in contact with the punch; cutting the rear end of the tube blank from a central line of the tube blank toward an outer side of the bending direction to make an end surface of the tube blank in contact with the punch flat; and deburring the front end and the rear end of the tube blank, and cleaning an inner side and an outer side of the tube blank.

8. The push-bending forming method of claim 7, further comprising:

(S1") spraying a lubricant on the outer side of the tube blank;

wherein the step (S1") is performed before the step (S1) and after the step (S1').

9. The push-bending forming method of claim 8, further comprising:

removing the lubricant from the tube blank.

* * * * *